United States Patent [19]

DeRoeck et al.

[11] 4,235,655

[45] Nov. 25, 1980

[54] CONTINUOUS COATING OF WEBS HAVING SPLICED JOINTS

[75] Inventors: Joseph I. DeRoeck, St. Katelijne-Waver; Frans Van Steenwinkel, Mortsel, both of Belgium

[73] Assignee: AGFA-GEVAERT N.V., Mortsel, Belgium

[21] Appl. No.: 934,722

[22] Filed: Aug. 21, 1978

[30] Foreign Application Priority Data

Aug. 23, 1977 [GB] United Kingdom ..... 35319/77

[51] Int. Cl.[2] ..... B31F 5/00

[52] U.S. Cl. ..... 156/157; 156/278; 156/280; 156/304.3

[58] Field of Search ..... 156/157, 266, 505, 304

[56] References Cited

FOREIGN PATENT DOCUMENTS 51-48067 4/1976 Japan .

*Primary Examiner*—Bernard D. Pianalto

*Attorney, Agent, or Firm*—William J. Daniel

[57] ABSTRACT

In the continuous high speed coating of webs having spliced joints by means of coating devices that are closely spaced from the webs, coating defects caused by the joints are avoided by splicing the webs by means of a splicing tape that is attached at one end to the front, i.e., coated, side of the old web and at the other end to the rear, i.e., uncoated, side of the new web, whereby only "step-up" discontinuities are formed at the splicing joint.

3 Claims, 3 Drawing Figures

CONTINUOUS COATING OF WEBS HAVING SPLICED JOINTS

The present invention relates to a method for the continuous coating the surface of moving webs with a layer of a coating composition, wherein the new web is spliced to the old web in a manner that does not disturb the coating process.

In many manufacturing operations a substantially continuous web is coated on one surface with a liquid material, such as aqueous solutions or dispersions of hydrophilic colloids, which may then be dried to form the desired product. Such manufacturing processes are used in the manufacture of adhesive tapes, magnetic recording tapes and photographic films and papers, among others. In order to increase the efficiency, and consequently lower the cost, of manufacturing these products, the coating process generally is carried out in a substantially continuous manner. Inasmuch as the web or support for the coating can only be obtained in finite lengths, a new supply roll of the web must be periodically spliced to the end of the preceding supply roll so that the coating process may continue without interruption.

It has been found that the most desirable way of splicing such webs is to utilize a splice tape extending across the web and joining the two adjacent ends of the web together. It has also been found that the application of the splice tape to the front side of the web, that is the side that is intended for receiving a coating, provides fewer coating flaws than does the application of the splice tape to the back side of the web. However, even though the application of the splice tape to the front side of the web results in fewer coating problems than do other methods of splicing, streaks and other defects have still been found in the coating downstream from the spliced joint. Normally, the spliced section of the continuous web cut from the finished product and is scrapped so that the defects in the coating occurring at the splice joint do not appear in the final product. However, it has been found that under certain conditions, the splice joint may affect substantial lengths of the coated web following, i.e. downstream, of the splice. In many products, it is possible to cut out the affected portion of the web without substantially affecting the usability of adjacent portions. However, in many products this is not possible, and the entire web containing such defects must be scrapped.

As the speed of coating webs is increased and as the width of the web products is also increased, the value of the product being scrapped due to splice-imparted defects downstream from the splice has become excessive. This is even more true in high-cost products utilizing an expensive coating material which cannot be easily recovered fom scrapped portions of the web. As a result, it has become increasingly important to minimize, if not eliminate, from the coated web products defects resulting from the splice. Moreover, the elimination of these defects must be accomplished without materially increasing the cost of the product.

Furthermore, the elimination of the splice-imposed defects must not in any way result in other, potentially less desirable defects in the coated product. Additionally, the method of eliminating the splice-imposed defects must be readily accomplished without affecting the production rates possible in modern high-speed coating machines.

Many of the defects in coated webs appear to result from the entrainment of air in the coating deposited on the web or from the adherence of a small bubble of air to the coating nozzle or to the coating lip of a so-called slide hopper which then affects further portions of the coating deposited on the downstream web. It has been found that such entrained air is picked up and such bubbles are generated as the coatng drops down over the splice tape onto the surface of the web. The air being entrained appears to come from that trapped in the angle formed between the butt edge of the tape and the surface of the web.

It has been proposed to eliminated disturbances in the layer of the coating composition downstream from a spliced joint in the web, by coating the web surface immediately downstream from the spliced joint, or by coating said web surface and the adjacent tape surface with a hydrophobic composition prior to applying the layer of coating composition.

It has further been proposed to form a tapered transition from the downstream edge of the splicing tape surface to the web surface. This may occur by feathering the downstream edge of the splicing tape, or by filling the transition from the tape surface to the web surface by an oily-hydrophobic material or with a rubber cement. It has still further been proposed to wet the splice member and the adjacent web surface immediately downstream from the splice member with water and, before the water dries, to coat the aqueous coating composition onto the web.

Finally, it has been proposed to vary the thickness of the leading end of the new web immediately downstream from the surface discontinuity at the splicing zone to provide to the web end facing the coating station a height which is not less than the height of the surface discontinuity.

While all the mentioned measures are effective in overcoming coating failures as described hereinbefore, they all require additional manipulations and expedients which, as for instance in the case of the filling of the transition from the tape to the web, are difficult to realize.

It is the object of the present invention to provide a method of splicing webs which reduces or even eliminates coating defects of the kind described hereinbefore, and which does not require any of the additional measures referred to.

The invention aims in particular to provide a method of splicing webs which are to be coated by means of a slide hopper or any other coating device that is very closely spaced from the web surface to be coated, wherein the threshold coating speed at which coating defects of the kind referred to start to occur, is higher than previously . As "usual speeds" we consider in the present case speeds ranging from 80 to 100 meters per minute ($m.min^{-1}$).

In accordance with the present invention, a method for the continuous coating of a moving web with a layer of a coating composition, is characterized by the improvement of carrying out the spliced joint in the web by means of a splicing tape that forms a flexible transition between the corresponding web ends that are separated from each other, and by fixing the tape to the trailing end of the receding or old web at its front or coated side and to the leading end of the new web at its back or uncoated side, thereby to provide only "step-up" discontinuities at the front side of the web splice that passes the coating head in the coating station. Thus, contrary to known splicing techniques that produce splice joints of the types known as butt and lap joints, the present technique can rather be described as producing an "interval joint with step-up edges only".

The term "front side" of the webs means the side of the web that is intended to receive a coating, as mentioned already hereinbefore, whereas the term "back side" of the webs means the opposite web side. It is thus clear that said terms have a relative meaning only, and a web which has been coated on one side in accordance with the method according to the invention, may as well be unwound again from the roll onto which it has firstly been wound, in order to be passed in reversed condition through another splicing and associated coating station or stations to receive a coating or coatings at its opposite side. This step is notably practised in the manufacture of, for instance, common radiographic film which is provided with a radiation-sensitive and an anti-stress layer on both its sides.

The terms 37 leading" and "trailing" have been used to designate physical position or location and are used in reference to the direction of travel of the webs.

The term "layer" stands not only for a single layer of a coating composition but it includes also a layer that is composed of several distinct layers that have different compositions and that maintain distinct relationship on coating.

Since the splicing tape has to pass through the clearance between the two web ends from one side of the webs to the opposite side, it will be understood that some minimum distance between the web edges is desirable in order to give the leading end of the new web the opportunity to be situated in the same position, or to follow the same path, as the trailing end of the receding web. A web end separation over a distance of at least ten times the web thickness may be considered as a practical minimum. However, it will be understood that, depending on the relative stiffness of the webs, the stiffness of the splicing tape, the radius of the roller about which the webs are wrapped for guiding them through the coater, and the web tension, this distance may be considerably greater, and thus a web separation of for instance 10 mm for webs of polyethyleneterephthalate of a thickness of 180 μm should not be considered as excessive.

The splicing tape may be formed from two standard selfadhesive tapes that are adhered in transversely staggered relation to each other with the adhesive layers in contact with each other, thereby to present two adhesive layer sections that are situated at opposite edges and at opposite sides of the composite splicing tape. A pair of tapes adhered to each other in this way can be wound into rolls of tape beforehand, for instance by the manufacturer of the tape. It will be understood, however, that the mutual taping together of the splicing tapes may also take place as they are unwinding in a tape dispenser that is mounted on the carriage that cuts and tapes the webs together as it moves transversely across the webs in an automatic web-splicer.

According to an alternative embodiment, the splicing tapes may be separately unwound in lengths corresponding with or slightly exceeding the width of the webs, one tape pressed onto the end of one web and the other tape pressed onto the end of the other web, at the other side, and then the freely protruding tape portions are pressed onto each other.

The splicing tape may also consist of one support that is provided with two adhesive bands that are situated at opposite margins and opposite sides of such support.

The invention will be described hereinafter with reference to the accompanying drawings wherein.

Figure 1:
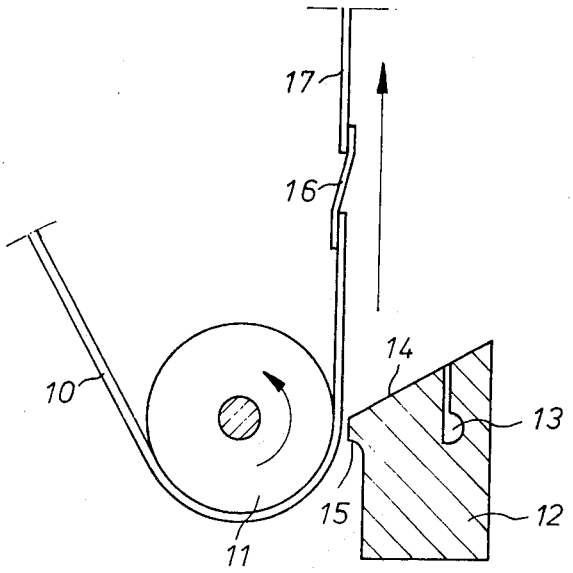
FIG. 1 is a schematic representation of a bead coater and of a web that has a spliced joint that has passed already through the coater.

Referring to FIG. 1, a web 10 is drawn over a web-supporting roller 11 through a coating station that in the present example has been illustrated as a slide hopper or bead coater. This coater may comprise a coating head 12 with a manifold 13 through which the coating composition is pumped outwardly onto a slide surface 14 from which it flows downwardly as a layer of uniform thickness. Contact of the layer with the web occurs through a so-called bead of the coating composition which may be stabilised by maintaining at the lower side of the lip 15 of the coater an air pressure that is lower than the air pressure at the upper side of the lip, said upper pressure being usually the environment air pressure. The spacing between the front side of the web and the front side of the lip 15 usually ranges between 0.2 and 0.3 mm.

The web 10 may be considered in the present embodiment as the new web, since it is spliced by a tape splice 16 to the web 17 which is the receding or old web that has already passed through the coating station. The tape splice may have different forms that are illustrated in FIGS. 2 and 3.

Figure 2:
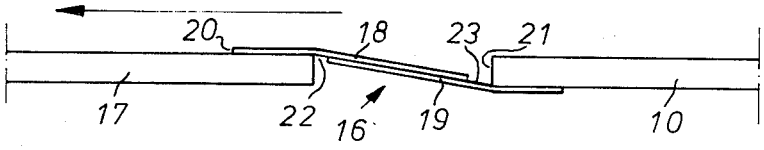
FIG. 2 is an enlarged schematic section through one embodiment of a spliced joint in accordance with the present invention.
Figure 3:
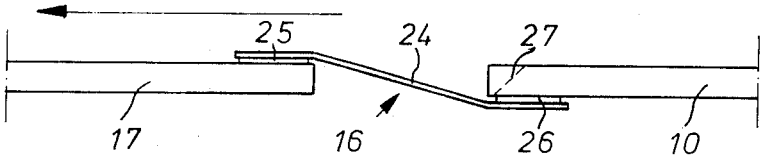
FIG. 3 is an enlarged schematic section through another embodiment of a spliced joint in accordance with the invention, the layer coated on the webs and the corresponding splices being omitted in both embodiments.

The splice joint 16 shown in FIG. 2 is formed by two tapes 18 and 19 that each have a self-adhesive layer on one side, and that have been adhered to each other in slightly staggered relation considered according to the width of the tapes, with their self-adhesive layers in contact with each other. The remaining free band of the self-adhesive layer of the tape 18 is adhered to the upper i.e. front side of the trailing end of the web 17, whereas the remaining free band of the self-adhesive layer of the tape 19 is adhered to the lower i.e. back side of the leading end of the web 10. It is clear that the described tape splice configuration has "step-up" discontinuities only—considered in the direction of movement of the splice past the coating station—namely the edge 20 of the tape 18 and the edge 21 of the web 10.

In the present FIG. 2 there has been shown a slight spacing between the edges of the tapes and the corresponding edges of the webs that do not adhere to each other, such as illustrated by the numerals 22 and 23. This has been done to illustrate that it is not critical that such tape edges should precisely meet the corresponding web edges. It has been shown that separations of some tenths of a millimeter can be allowed whereas in some cases said separation may even become negative, that is, the second tape may slightly underlie the first tape so that at the extremities of the webs the thickness of the web end is increased by two times the tape thickness. It should in any case be understood that the adhesive zone of a tape that is in contact with a web should be sufficiently large in area to establish a bond with the web that withstands the usual longitudinal tensions in the web during its winding and unwinding, the corrections of the lateral position of its path of travel, accelerations in web accumulators, etc.

The following example illustrates the described embodiment.

Two polyethyleneterephthalate webs with a thickness of 180 μm that were provided at their front side with a subbing layer, were spliced by means of two polyester tapes that had a width of 32 mm and a thickness of 50 μm, of the self-adhesive layer. The tapes overlapped each other over a distance of 22 mm, and the gaps at the points 22 and 23 were not greater than 0.1 mm, so that the widths over which the tapes were in contact with the corresponding web ends were neglectably smaller than 10 mm. The tapes were provided at their rearside with a subbing layer of the type applied to the webs thereby to not disturb the coating of an aqueous gelatinous silver halide layer. It was shown that bead coating of a layer of an aqueous silver halide radiographic composition by means of the illustrated coater could occur at speeds up to 130 m $min^{-1}$, for a web-coater spacing of 0.3 mm, without the occurrence of any of the coating defects described hereinbefore. In comparison therewith, the coating of the same composition was limited to a speed of 100 m $min^{-1}$ if the webs were butt-joined by a tape of 50 μm applied to the front side of the webs, and the downstream tape end and the adjacent web end were coated with a hydrophobic composition.

The splice joint 16 shown in FIG. 3 is made by means of a single tape 24 that is provided at opposite margins with bands 25 and 26 of a self-adhesive material. Supply of this kind of tape in the form of a roll of tape does not offer problems since the thickness of the tape at both its marginal zones is equal. It may be seen that, similarly to the embodiment of FIG. 2, only "step-up" edges are formed by the tape splice at the front side of the webs (the upper web side in the drawings of FIGS. 2 and 3.)

Finally, the broken line 27 in FIG. 3 shows that the leading edge of the new web 10 may occasionally be bevelled or feathered. This configuration may be desirable at elevated coating speeds since in such case the passage of an unbevelled extremity of the new web 10 may disturb the coating bead in such a way that the thickness of the coated layer is briefly reduced and immediately thereupon correspondingly increased. Although such defect may be limited to a web length of some centimeters only, the consequence may be that the locally thicker layer cannot be dried by an existing drying installation so that in that way an undesirable limitation might be imposed upon the coating speed.

We claim:

1. In a method of continuously coating a moving web with a layer of a coating composition wherein the web is advanced along a path adjacent a coating station for the application of the coating layer to the front web surface and from time to time the leading end of a fresh web is spliced to the trailing end of the exhausting web, the improvement of splicing said web ends while separated from each other by a distance of at least ten times the web thickness by means of a splicing tape that forms a flexible connection therebetween, said tape having its leading margins ahered to the front surface of the trailing end of the old web and its trailing margin adhered to the reverse surface of the leading end of the new web whereby the only discontinuities at the front face of the spliced web joint presented to the coating station are "step-up" discontinuities.

2. A method according to claim 1, wherein said splicing tape is formed from two lengths of tape each having a self-adhesive layer on opposite surfaces thereof, said lengths being adhered to each other in widthwise staggered relation with the adhesive layers in contact with each other, leaving exposed adhesive margins that are situated at opposite ends and on opposite sides of the resultant composite tape.

3. A method according to claim 1, wherein said splicing tape comprises a single flexible support having two marginal regions located at opposite ends and on opposite sides thereof, each such region carrying a self-adhesive layer.

* * * * *